United States Patent [19]

Wolkowicz

[11] 4,101,706

[45] Jul. 18, 1978

[54] STRAPPING TAPES

[75] Inventor: Richard I. Wolkowicz, Scotch Plains, N.J.

[73] Assignee: Sun Chemical Corporation, New York, N.Y.

[21] Appl. No.: 830,788

[22] Filed: Sep. 6, 1977

Related U.S. Application Data

[63] Continuation-in-part of Ser. No. 672,027, Mar. 30, 1976, abandoned, which is a continuation-in-part of Ser. No. 503,330, Sep. 5, 1974, abandoned.

[51] Int. Cl.[2] ..... D04H 3/02

[52] U.S. Cl. ..... 428/294; 428/295; 428/297; 428/338; 428/339; 428/364; 428/392; 428/395

[58] Field of Search ..... 428/74, 114, 222, 294, 428/295, 297, 395, 332, 338, 339, 364, 392, 395, 474

[56] References Cited

U.S. PATENT DOCUMENTS

| | | | |
|---|---|---|---|
| 2,750,315 | 6/1956 | Tierney | 428/295 |
| 3,073,734 | 1/1963 | Bemmels | 428/294 |
| 3,538,974 | 11/1970 | Marzocchi | 74/231 R |

*Primary Examiner*—James J. Bell
*Attorney, Agent, or Firm*—Cynthia Berlow

[57] ABSTRACT

Strapping tapes for use as tiedowns for mobile houses and cargo, cargo slings, and the like are composites of plastic film and parallel, continuous high tensile low elongation fibers that have been twisted, plied, and extrusion-coated with a low modulus plastic, wherein the twisted, plied fibers are arranged in a compartmentalized single layer in the plastic jacket.

4 Claims, 3 Drawing Figures

STRAPPING TAPES

This application is a continuation-in-part of copending application Ser. No. 672,027 (filed Mar. 30, 1976), now abandoned which was a continuation-in-part of application Ser. No. 503,330 (filed Sept. 5, 1974), now abandoned.

This invention relates to strapping tapes. More particularly it relates to strapping tapes that comprise composites of plastic film and high tensile, low elongation fibers.

The need for tiedowns for mobile homes has become especially important as both the number of mobile homes and the frequency and violence of tornadoes have increased in recent years. Mobile homes of necessity are lightweight in construction, generally with flat sides and ends, making them vulnerable to high winds. During a heavy wind, one is 20 times as likely to be killed in a mobile home as in a conventional structure. Legislation is being urged by National Weather Service tornado experts to require the tying down of all mobile homes to protect them better from tornadoes and other high winds.

In general, a satisfactory tiedown tape should have high dielectric strength in order to prevent galvanic-type corrosion. It should be light and easy to handle and safe to install and use, that is, the coils should not spring open with hazardous force nor should the edges be sharp. It should have a high flex life. It should be weather and fire resistant and suitable for use at both low and high temperatures.

To comply the the Ansi Standard A119.1 for Mobile Homes, a strapping tape must have a working load of 3150 pounds with a capability of 50 per cent overload (4725 pounds) and a maximum elongation of 2 per cent at the working load. Furthermore, strapping tapes must be suitable for use with the anchor heads employed in the mobile home industry, limiting the maximum dimensions of the strap to 0.049 × 1.5 inches. Such anchors, i.e., slotted bolts which terminate the strap by passing it through the slot, wrapping it upon itself, and then locking the bolt so that it cannot turn, generally have terminating diameters of about ¾ to 1 inch for mobile home tiedowns and of about 2 to 4 inches for seat belt clamps.

Tapes for use as tiedowns for mobile homes as well as for cargo, as cargo slings, as reinforcing straps for lawn furniture, and the like most commonly have been made of steel wire, galvanized steel straps, and composites of a plastic sheath and filaments of yarn. Although acceptable for the intended end uses, these products have many serious disadvantages. For example, steel is stiff and it rusts; in addition, it has poor flexibility, low dielectric strength, fair corrosion resistance, and high edge sharpness. Webbing made by weaving nylon fibers has very high elongation. Tapes containing glass fibers are not sufficiently flexible. Polyester tapes have low tensile strength and high elongation. Polypropylene strapping weathers poorly and has high elongation.

Strapping tapes comprising laminates of parallel, continuous, high tensile, low elongation fibers between two plastic films are known. In general in such tapes the single fibers are twisted and arranged in two or more uniform layers, as shown in FIG. 2. When such a strap is placed under tension, the strapping spreads at the bends, such as in the anchoring head, the fibers trying to form a single layer. This causes splitting of the strap, increased tension on the edges, and flow of the strap to areas where the fiber can be cut. Since the strap has low elongation, the fibers at the edge elongate first, causing them to break before the fibers in the center, thus lowering the tensile strength of the strap at the bend.

Strapping tapes that do not spread and so have improved tensile strength can be obtained by first twisting the single strands of fibers, plying the twisted strands, and then extrusion-coating the plied twisted strands arranged in a single layer, as shown in FIG. 3. If, however, the sides are stressed as indicated by the arrows in FIG. 3, the fibers lose adhesion and are free to move, resulting in a product resembling an extrusion-coated rope which is too thick for many anchor heads and exhibits a non-uniform loading of the fibers under stress, thus lowering the tensile strength.

It has now been found that all of the above criteria can be met and the disadvantages overcome by the products of this invention wherein plied twisted fibers are compartmentalized in a single layer in the plastic jacket, as shown in FIG. 1. The tape of this invention has high tensile strength and low elongation; it comprises groups of plied twisted fibers arranged in a single layer in at least two spaced-apart compartments in a plastic jacket; each compartment contains at least one group of plied twisted fibers and each consecutive pair of compartments is separated by a portion of the plastic containing no fibers; the groups of fibers are separated from one another by a spacing of plastic that is sufficiently wide that it does not allow the fibers under stress to form one bunch of fibers. Each group acts individually, rather than bunching, and so prevents the non-uniform spreading and forming of a rope which reduce tensile strength.

By keeping the compartments sufficiently small, the strap is kept within the dimensional restraints of most anchor systems. In addition, the compartmentalized straps of this invention are safer than those previously known, since in the case of failure the strapping does not recoil. As few as one and as many as fourteen groups per compartment are suitable; to minimize roping, there must be at least two compartments.

In general, the tapes of this invention are composites of parallel, continuous, high tensile, low elongation fibers that have been twisted, plied, arranged in a compartmentalized single layer, and jacketed with a low modulus plastic.

The composite may be made in any known and convenient manner. In a preferred embodiment the tapes are prepared by the steps of twisting, plying, and coning the single fibers, placing the cones on a creel, passing the fibers from the cone creel through a reed into a pressure head where the fibers are jacketed with a low modulus plastic.

By laying down unidirectional fibers in a parallel array, these tapes utilize substantially all of the strength of the fibers while at the same time keeping the elongation to a minimum, i.e., about 2 to 4%. When the same fibers, however, are woven into a fabric, the elongation is increased, i.e., to about 10%, making it undesirable to use such woven products as tiedown tapes.

The invention will be more fully understood from the following description of the accompanying drawings in which.

Figure 1:
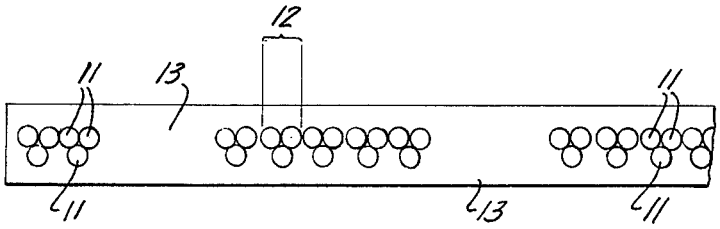
FIG. 1 is a cross-sectional view of the composite of plastic film and fibers of this invention.

Now referring to the FIGURES, in FIG. 1 plies 12 of twisted fibers 11 are arranged in compartments and jacketed in a low modulus plastic 13.

Figure 2:
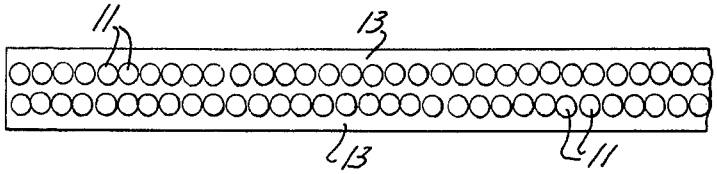
FIG. 2 is a cross-sectional view of a known composite of plastic film and fibers.

In FIG. 2 twisted single fibers 11 are jacketed in a low modulus plastic 13.

Figure 3:
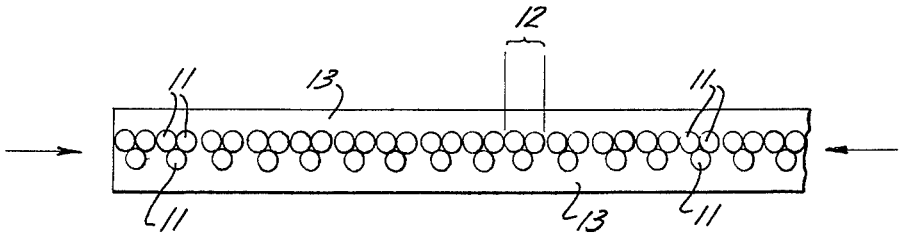
FIG. 3 is a cross-sectional view of another known composite of plastic film and fibers.

In FIG. 3 plies 12 of twisted fibers 11 are arranged in a single layer and jacketed in a low modulus plastic 13.

The fibers 11 of the products of this invention are generally long chain aromatic polyamides, typical of which is du Pont de Nemours & Company's "Kevlar" or "Fiber B."

Typical low modulus plastics that are suitable for the products of this invention include, but are not limited to, polyvinyl chloride, ethylene-vinyl chloride copolymers, acrylic polymers and copolymers, polyolefin homopolymers and copolymers, and polyurethanes. The plastic jacket or sheath 13 for the tapes is preferably a film of polyvinyl chloride, but other useful materials include films of polyethylene, polypropylene, polyurethane, polyesters, acrylics, chlorinated polyethylene, rubber, and the like.

It is also within the scope of this invention to include in the plastic conventional amounts of conventional ingredients, such as stabilizers, pigments, lubricants, fire retardants, and processing aids.

In general, the jacket 13 is at least 4 to 5 mils thick on each side of the plied twisted fibers 12; it may be white or colored.

Although the preferred twist level for the fibers is twisting the single strands with two turns per inch and plying these twisted strands with two turns per inch, any twist level can be used that will make a non-spreading fiber which can be laid in a single layer to fit the dimensional constraints and have low elongation. Several suitable twist levels are shown in Table I below; in each case the strength was tested at a strain rate of 12 inches/minute and the fiber was 1500-denier Kevlar 29:

TABLE I

| | Tensile Strength, Pounds | Elongation, % |
|---|---|---|
| 3 plies of fiber, each twisted with 5 turns/inch and plied with 3 turns/inch | 190 | 4.0 |
| 3 plies of fiber, each twisted with 2 turns/inch and plied with 3 turns/inch | 219 | 4.2 |
| 3 plies of fiber, each twisted with 1.2 turns/inch and plied with 3 turns/inch | 213 | 4.0 |
| 3 plies of fiber, each twisted with 2 turns/inch and plied with 2 turns/inch | 219 | 4.15 |

In general these tapes are about 1.375 inches wide and about 0.048 inch thick, weighing about 2.4 pounds/100 feet. The physical properties of a tape consisting of 36 ends of 3-plied 1500-denier Kevlar fiber twisted with two turns/inch in the single strands and plied with an opposite twist of two turns/inch in the strands, jacketed with a polyvinyl chloride resin, forming a composite 48 mils thick, and tested in a Minuteman Anchor Co. terminating device having a ¾-inch diameter bolt, are listed below in column (A). For comparative purposes the properties of steel strapping (35 mils thick, 1.25 inches wide) are listed in column (B) and of a tape made with polyester fibers in column (C) of Table II:

TABLE II

| | (A) | (B) | (C) |
|---|---|---|---|
| Tensile strength at break lbs. | 4,960 | 4,750 | 5,200 |
| Elongation at break, % | 2.5 | 9.4 | 14 |
| Elongation at 3,150 lbs. working load, % | 1.4 | 1.6 | 8.5 |
| Weight/100 feet, lbs. | 2.4 | 38.4 | 6.0 |
| Dielectric strength | high | low | high |
| Rusting | none | rusts | none |
| Corrosion resistance | good | fair | good |
| Flexibility | good | poor | good |
| Stiffness | low | high | low |
| Safety | excellent | poor | excellent |
| Edge sharpness | low | high | low |
| Cut resistance | good | excellent | fair |
| Tensile strength, psi | 400,000* | 111,000 | 50,000–170,000* |

*uncoated fibers

With other terminating devices having different diameters, strapping tape (A) in Table II also gave excellent results, as shown in Table III below:

TABLE III

| Terminating Diameter, inches | Tensile Strength, pounds | Elongation, % at break | Elongation, % at 3150 lbs. |
|---|---|---|---|
| ⅝ | 4450 | 2.5 | 2.0 |
| 1 | 5556 | — | — |
| 2 | 6506 | 3.2 | 1.9 |
| 4 | 6946 | — | — |

Thus it can be seen that the tapes of this invention are resistant to corrosion, light, flexible, and safe. They have the high tensile strength and low elongation that ideally suit them for use in tying down mobile homes and cargoes, they meet the requirements of the Ansi Standard A119.1 for Mobile Homes with regard to working load and elongation, and they are well suited for use with the majority of anchor heads employed in the mobile home industry.

Although there have been described preferred embodiments of this novel invention, many variations and modifications will now be apparent to those skilled in the art. This invention, therefore, is to be limited not by the specific disclosure herein, but only by the appended claims.

What is claimed is:

1. A strapping tape having high tensile strength and low elongation comprising groups of plied twisted long-chain aromatic polyamide fibers arranged in a single layer in at least two spaced-apart compartments in a plastic jacket, each compartment containing at least one group of plied twisted fibers and each consecutive pair of compartments being separated by a portion of the plastic containing no fibers, said portion of separating plastic being of sufficient width to prevent roping and spreading when the tape is under stress.

2. The tape of claim 1 wherein the plastic is polyvinyl chloride.

3. The tape of claim 1 wherein the plastic jacket is at least 4 to 5 mils thick on each side of the plied twisted fibers.

4. The tape of claim 1 which is about 1.375 inches wide and 0.048 inch thick.

* * * * *